United States Patent [19]

Davis

[11] 4,097,066

[45] Jun. 27, 1978

[54] SHEET ENTRY AND AUTOMATIC COPYING APPARATUS

[76] Inventor: Herbert C. Davis, 6321 Oak Ct., Lakeland, Fla. 33803

[21] Appl. No.: 635,046

[22] Filed: Nov. 25, 1975

[51] Int. Cl.[2] ..... B41L 3/10

[52] U.S. Cl. ..... 282/29 B

[58] Field of Search ..... 282/29 A, 29 B, 29 R

[56] References Cited

U.S. PATENT DOCUMENTS

| | | | |
|---|---|---|---|
| 863,480 | 8/1907 | Wolf | 282/29 B |
| 2,658,774 | 11/1953 | Kraemer | 282/29 B |
| 2,722,436 | 11/1955 | Preiffer | 282/29 B |
| 2,734,756 | 2/1956 | Selinker et al. | 282/29 B |
| 2,793,882 | 5/1957 | Keck | 282/29 R |
| 2,836,433 | 5/1958 | Dolan | 282/29 B |
| 2,861,819 | 11/1958 | Apol | 282/29 B |
| 2,952,478 | 9/1960 | Loctie | 282/29 B |
| 3,073,625 | 1/1963 | Petit | 282/29 B |
| 3,142,496 | 7/1964 | Rideout | 282/29 A |

FOREIGN PATENT DOCUMENTS

| | | | |
|---|---|---|---|
| 944,966 | 12/1963 | United Kingdom | 282/29 A |

*Primary Examiner*—Jerome Schnall

*Attorney, Agent, or Firm*—George H. Baldwin; Arthur G. Yeager

[57] ABSTRACT

Apparatus for use in making entries on a plurality of superimposed sheets with duplication media therebetween and includes a writing board and a smaller movable carriage plate mounted in a guideway of the board, guideway having stops therein to prevent dislodgement of the plate from the board. Indexing projections are attached to the plate for selectively fixing the position of the plate which cooperate with indentations of the guideway. A pair of pins extend upwardly from the board for releasably connecting a record sheet thereto with such sheets at least partially overlying the plate and board. A shield is disposed in at least partially overlying relation to the plate and a record sheet is positionable between the shield and plate. The shield has an elongated horizontal opening for transferring information from pertinent data areas on an entry sheet or check to the record sheet. Entry sheet-positioning and retaining device including a pair of spaced pins and a spring loaded pressure foot is disposed on the plate for selectively connecting the entry sheet to the plate. An anvil extends upwardly from the plate within the shield opening whereby the transfer sheet will be substantially in the plane of the upper surface of the shield.

18 Claims, 9 Drawing Figures

SHEET ENTRY AND AUTOMATIC COPYING APPARATUS

BACKGROUND OF THE INVENTION

1. Field of the Invention

This invention relates to accounting systems and more particularly to a sheet entry and automatic copying apparatus in which the entry sheet is a check and the record sheet is a check and deposit, income and expense register in the nature of a financial journal.

2. Description of the Prior Art

There are many bookkeeping devices, accounting systems, payroll boards and the like in the prior art and all of the patents found in the search of this invention are the following U.S. Pat. Nos. 1,206,745; 2,485,513; 2,638,360; 2,648,547; 2,678,223; 2,861,819; 3,142,496; and 3,315,985. There are many problems encountered in the various devices of the prior art and this invention seeks to overcome some of such prior art problems and to improve the art of sheet entry and automatic copying apparatus which is modern and adapted for use in current banking practices and for use by an individual to maintain and control his household and/or his entire personal expense and income accounts.

SUMMARY OF THE INVENTION

The sheet entry and automatic copying apparatus of the present invention has been devised for use in making entries on a plurality of sheets positionable in superimposed relation on the apparatus with duplication media between the sheets and is seen to include a writing board and a smaller movable plate positioned above and on such board. Guide means are connected to the board for movably mounting the plate on the board in a generally rectilinear manner, and indexing means are attached to the plate for selectively fixing the position of the plate in the guide means. Record sheet-positioning means are disposed on the board for releasably connecting a record sheet thereto with such sheet at least partially overlying the plate and board. A shield is disposed in at least partially overlying relation to the plate and is selectively movable to position a record sheet between such shield and plate, the shield including an opening therethrough for transferring information from pertinent data areas of an entry sheet, in the form of a check, to a record sheet. Entry sheet-positioning means are disposed on the plate for releasably connecting an entry sheet thereto with such sheet disposed in generally overlying relation to the shield with pertinent data areas of such sheet overlying the shield opening, such sheet having duplication media on the rear surface of such sheet beneath the pertinent data areas.

According to other aspects the invention has an anvil incorporated onto the plate and has a shape complementary to and slightly smaller than the shield opening, such anvil being of a thickness substantially the thickness of the shield whereby the record sheet positioned overlying the anvil will be substantially in the plane of the upper surface of the shield and preventing undue writing interference caused by the shield opening. The shield opening is defined by a single horizontal slot and is substantially underlaying a duplicating media disposed on the rear surface of an entry sheet with the pertinent data areas being disposed thereabove. Also, the shield is removably attached to the plate and includes means for positioning the shield onto the entry sheet-positioning means prior to locating an entry sheet thereon.

In further aspects the entry sheet-positioning means includes a pair of spaced pins extending upwardly from the plate and each of the shield and entry sheets include spaced openings aligned with and positioned onto respective pins. Similarly the record-sheet positioning means includes a pair of spaced pins extending upwardly from the board for receiving complemental spaced openings of a transfer sheet thereon.

Yet in other aspects, a ready releasable securing means is attached to the plate for engaging and fixing an entry sheet in its proper position on the entry sheet-positioning means and maintaining same in that position during writing on the entry sheet, such securing means including spring means for biasing same in an engaging direction with respect to the entry sheet.

Preferably the board is generally ractangular with the guide means being disposed along the left side board edge portion and the record sheet-positioning means is disposed adjacent the top board edge portion. Stop means extend upwardly from the board and at each end of the guide means to limit the movement of the plate to within the area defined by the board. Also, the board includes an upper surface for supporting a portion of a record sheet, and the plate has an upper surface generally coplanar with the board upper surface, and with the shield thereon, the upper surface of the shield and board upper surface are substantially coplanar.

Furthermore, the guide means preferably is defined by an elongated element disposed spacedly above the board and forming a guideway with an edge portion of the plate being slidingly disposed in the guideway. The indexing means is attached to the plate edge portion and includes a pair of spaced projections with the element having a plurality of spaced indentations cooperatively disposed with the projections whereby the plate may be selectively moved along and indexed on the element.

A general object of the invention is to provide an improved sheet entry and automatic copying apparatus.

A particular object is the provision of a check writing apparatus in which pertinent data is simultaneously recorded on a record sheet or check register.

A related object is to record the information simultaneously on duplicate record sheets.

Another particular object is to provide a shield between the check and record sheet whereby the pressure of the writing instrument only causes transfer of the information from the check through a selected opening or openings in the shield onto a record sheet.

A related object is the provision of a plate beneath the record sheet with an anvil complementary to the shield opening whereby the surface of the record sheet is raised by the anvil to substantially the plane of the shield whereby interference by the edges of the opening in the shield with the writing instrument is minimized.

A specific object is to provide an improved indexing means for the sliding plate on the board which holds the transfer sheet and with improved positioning means thereon for maintaining the record sheet in position.

Another specific object is the provision of an improved entry sheet or check holder attached to the plate and positioning means for the check with the shield positionable on the means whereby the shield may be removed and replaced as required.

Other objects include an apparatus of the type described which is readily manufactured and assembled, easy and reliable in use and durable in construction.

BRIEF DESCRIPTION OF THE DRAWINGS

The novel features which are believed to be characteristic of this invention are set forth with particularity in the appended claims. The invention itself, however, both as to its organization and method of operation, together with further objects and advantages thereof, may best be understood by reference to the following description taken in connection with the accompanying drawings, in which:

DESCRIPTION OF THE PREFERRED EMBODIMENT

Figure 1:
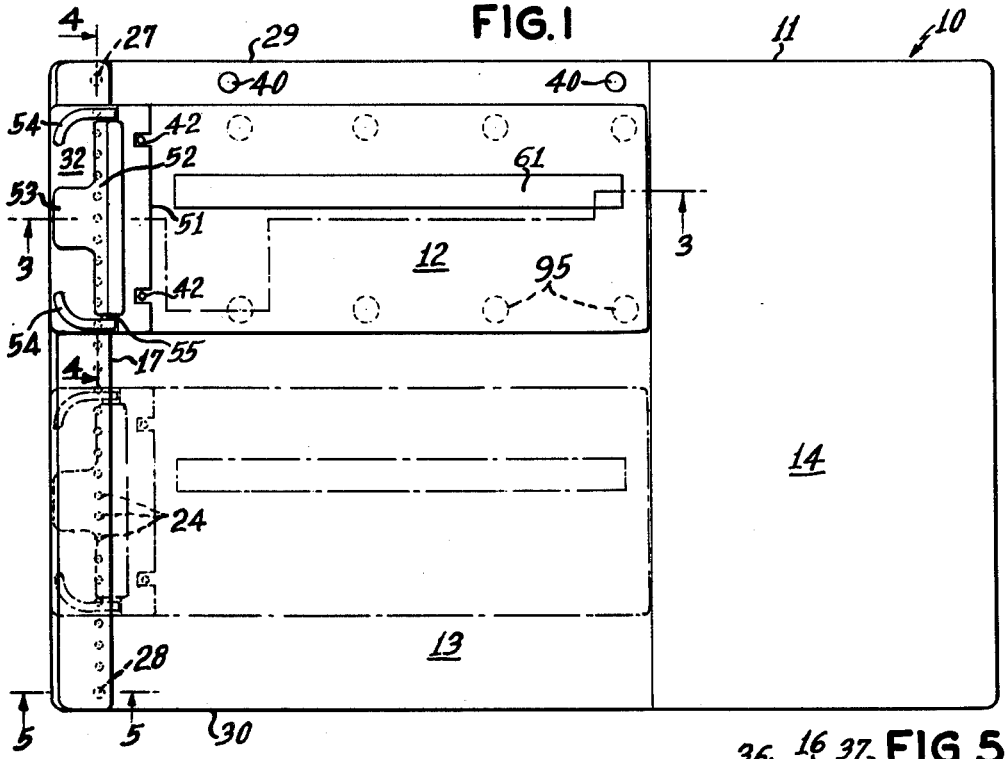
FIG. 1 is a top plan view of the sheet entry and automatic copying apparatus in accord with the invention, with the shield removed therefrom and the carriage plate being shown in another position by broken lines for clarity of illustration.
Figure 6:
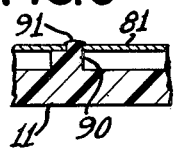
FIG. 6 is an enlarged cross-sectional view taken along line 6—6 of FIG. 2.

Referring now more particularly to the drawings of FIGS. 1, 2 and 3 the sheet entry and automatic copying apparatus is generally designated by reference numeral 10, such apparatus being adapted for use in making entries on a plurality of sheets positionable on portions of the apparatus in superimposed relation, with duplication media between some of the sheets, as hereinafter more particularly described. Apparatus 10 includes a rectangular writing board 11 of a predetermined area, approximately 8½ by 12½ inches, a movable carriage plate 12 of an area, approximately 3 by 7½ inches, movably positioned above board 11. Board 11 includes a recessed portion 13 for accommodating plate 12 in its various movable positions and a record sheet supporting portion 14 which is adapted to provide a writing base for a record sheet for entry of data directly thereto.

Figure 5:
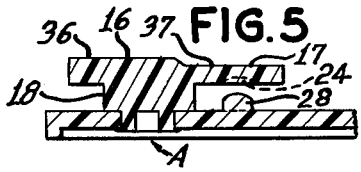
FIG. 5 is enlarged cross-sectional view taken along line 5—5 of FIG. 1.
Figure 2:
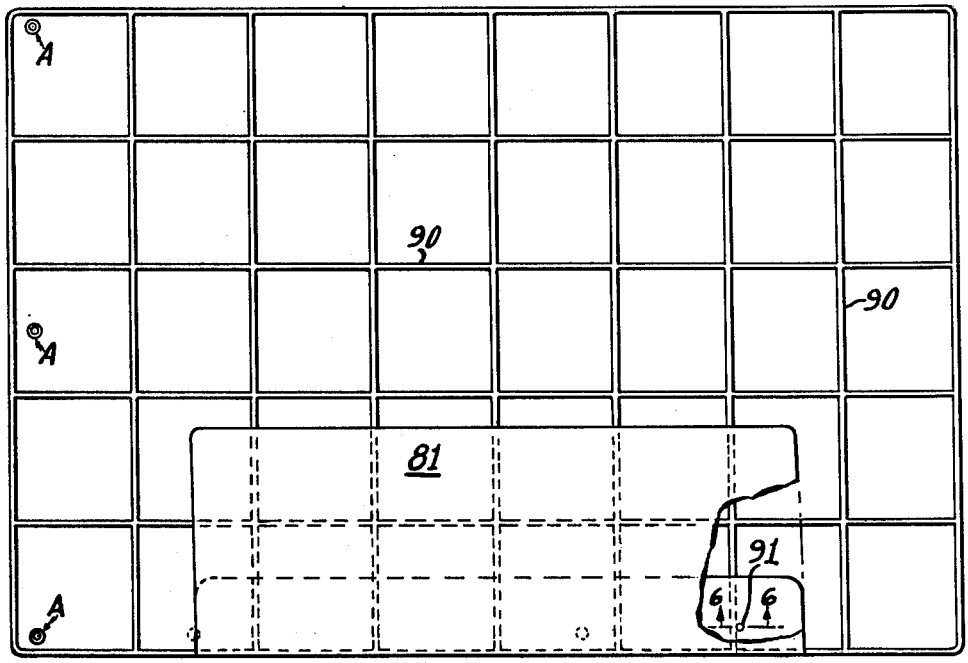
FIG. 2 is a bottom view thereof with a portion of the flap being broken away.
Figure 4:
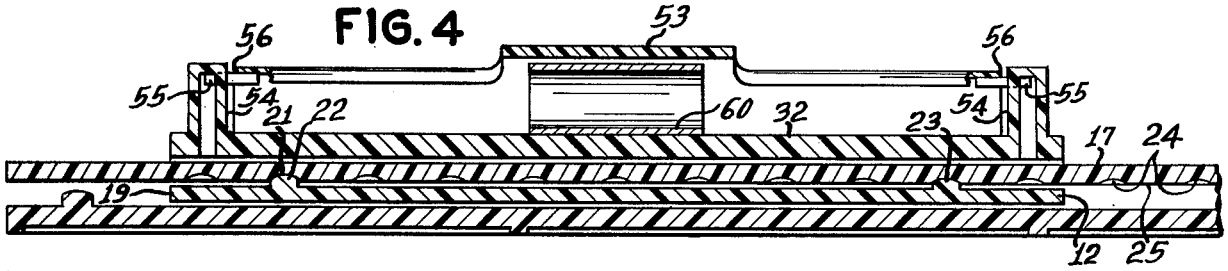
FIG. 4 is an enlarged cross-sectional view taken along line 4—4 of FIG. 1.

Connected along the left edge portion 15 of board 11 is a guide means 16 for movably mounting the plate 12 to the board 11 and is seen to include an elongated element 17 disposed spacedly above board 11 and leg 18 depends therefrom and affixed to board 11 in any suitable manner, as by the peg-hole-glue manner illustrated by A in FIGS. 2 and 5. Plate 12 has an edge portion 19 disposed in the guideway 20, formed by element 17, leg 18 and board 11, for sliding movement upwardly and downwardly in the recessed portion 13 of board 11. To position plate 12 in selected locations, indexing means 21 in the form of a pair of spaced projections 22 and 23 extend upwardly from plate edge portion 19, such projections cooperating with a spaced pair of a plurality of indentations 24 formed in and along the bottom surface 25 of element 16, as clearly illustrated in FIG. 4. The plate 12 and the element 16 are sufficiently resiliently deformable to permit ready movement of plate 12 when in their deformed conditions, while maintaining accurate positioning in appropriate indexed positions in their normal or undeformed condition.

Figure 8:
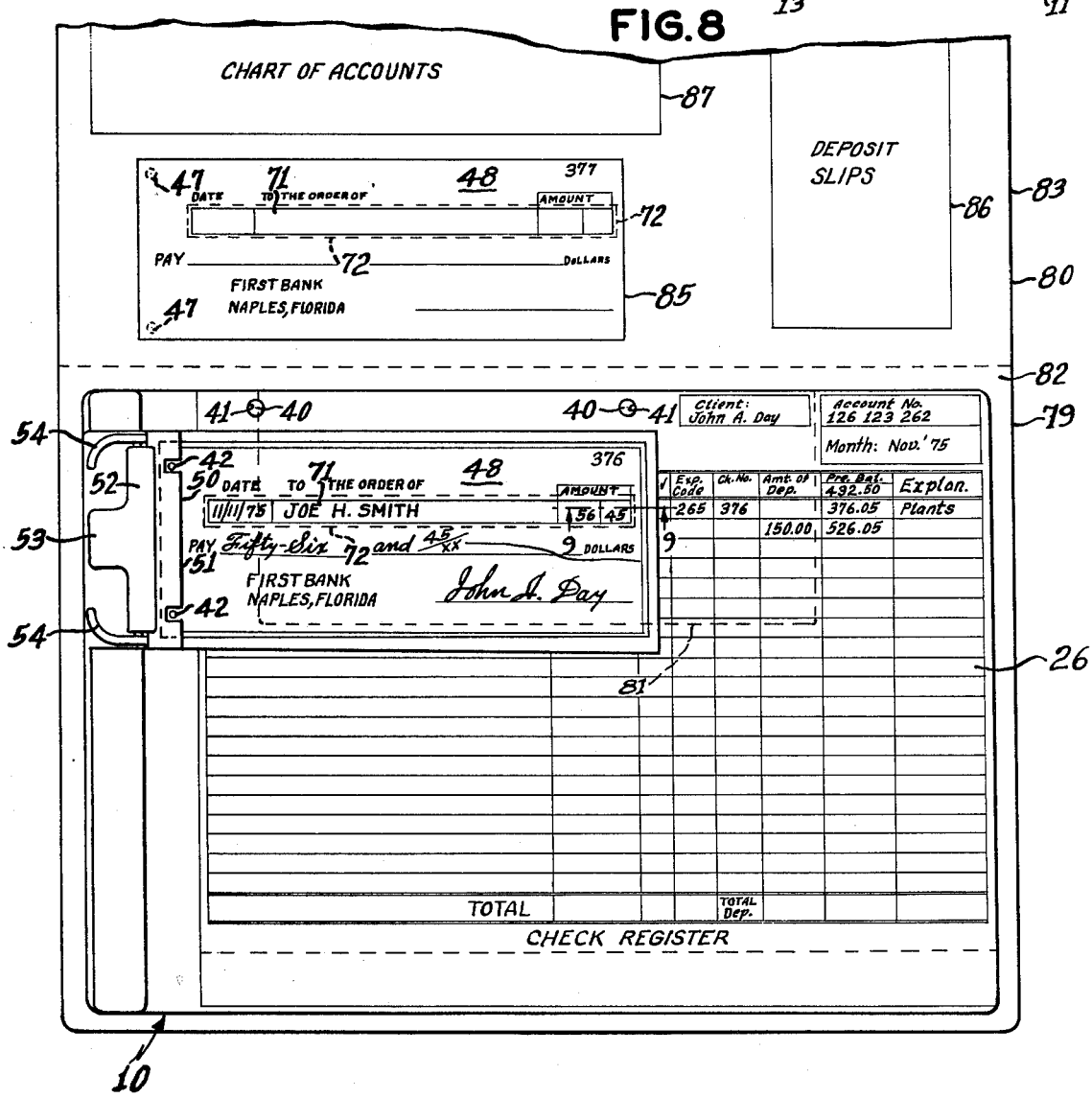
FIG. 8 is a top plan view of the invention associated with a check book holder.

The indexing means 21 has herein been designed to permit plate 12 to be selectively moved into twenty positions corresponding to the 20 lines on record sheet means 26, as seen in FIG. 8. To limit the travel of plate 12 in guideway 20, a pair of stops 27 and 28 extend upwardly from the left edge portion 15 of board 11 into the guideway 20 and respectively adjacent board top and bottom edges 29 and 30 thereby caging the edge portion 19 within guideway 20.

An inverted channel shaped support member 32 is attached along edge portion 29 and cages element 17 therein, member 32 including a left upright wall 33 slidingly engaged against left edge 34 of element 17, with the bottom 35 of channel member 32 being partially engaged against the left surface portion 36 of element 17. The right surface portion 37 is undercut or in a plane lower than left surface portion 36 to provide a clearance space 38 to permit deformation of edge portion 19 slightly downwardly and/or deformation of element 17 slightly upwardly whereby projections 22 and 23 may become dislodged from depressions 24 by a force of a predetermined amount when channel member 32 is moved rectilinearly along element 17 with edge portion 19 of plate 12 being disposed within guideway 20.

Record sheet-positioning means in the form of a pair of spaced and tapered pegs or pins 40 extend upwardly from recessed board portion 13 adjacent top edge 29 for receiving corresponding spaced openings 41 of record sheet means 26, as seen in FIG. 8. It is to be understood that additional pins could be provided, for example, adjacent bottom edge 30 to more firmly position and maintain record sheet means 26 on board 11.

Figure 3:
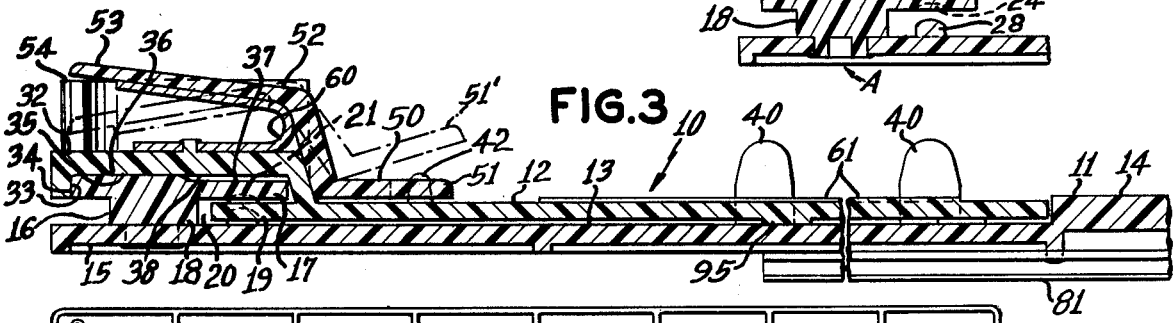
FIG. 3 is an enlarged cross-sectional view taken along line 3—3 of FIG. 1 with the portion between the board indexing pins being removed.
Figure 7:
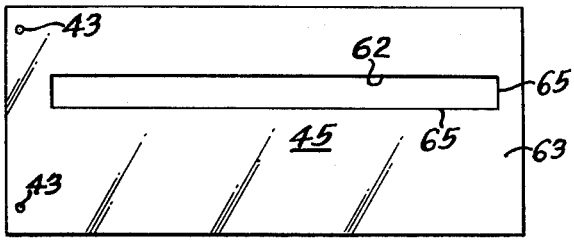
FIG. 7 is a top plan view of the shield in accord with the invention.

Entry sheet-positioning means in the form of a pair of spaced and tapered pegs or pins 42 extend upwardly from the carriage plate 12 adjacent edge portion 19 for initially receiving correspondingly spaced openings 43 in shield 45 and then receiving correspondingly spaced openings 47 of an entry sheet or check 48, as clearly indicated by reference to FIGS. 3, 7 and 8. To prevent inadvertent slippage of check 48 from its location overlying shield 45 positioned by the cooperative action between openings 47 and pins 42, releasable securing means 50 are provided which engage check 48 and forcibly maintains the check 48 in position. Securing means 50 includes a pressure foot 51 depending from a pivotally supporting element 52, element 52 having a handle 53 adjacent left board edge 15 whereby handle 53 may be depressed to cause the pressure foot 51 to become disengaged with check 48 and thus may be removed from pin engagement with pins 42. Extending upwardly from channel shaped support member 32 is a pair of spaced walls or flanges 54 with openings (not shown) therethrough for receiving aligned pivot pins 55 extending outwardly from the side edges 56 of element 52. A compression spring 60, in the shape of U, is suitably mounted to and between support member 32 and element 52 and/or handle 53, as clearly shown in FIGS. 3 and 4. Thus, handle 53 may be depressed which causes element 52 to pivot on aligned pins 55, forming an axis generally parallel to guideway 20, and raise pressure foot 51 to its broken line position 51′ whereby check 48 may be inserted or removed from pins 42 (likewise shield 45 may be inserted or removed from pins 42).

Figure 9:
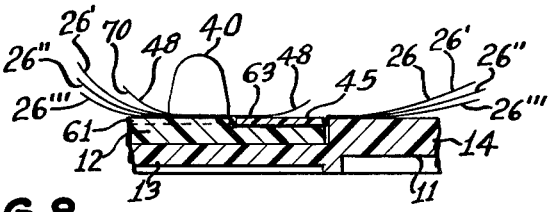
FIG. 9 is an enlarged cross-sectional view taken along line 9—9 of FIG. 8.

Referring now more particularly to FIGS. 3, 8 and 9, the anvil 61, having a thickness corresponding substantially to the thickness of shield 45, extends upwardly from plate 12 and is slightly smaller than and fits within the horizontal slot 62 of the shield 45. With the record sheet means 26, including top register or record sheet 26', intermediate carbon sheet 26" and bottom register or record sheet 26"', is disposed beneath shield 45 and is raised by anvil 61 within the shield opening 62 so that the sheet means 26 is substantially in the plane of the upper surface 63 of the shield 45 whereby the writing instrument will not be materially effected by the edges 65 constituting the opening 62 of shield 45.

On the rear surface 70 of checks 48 and beneath the horizontal row 71 of pertinent data areas, identified as DATE TO THE ORDER OF and AMOUNT, is a coating of duplicating medium 72, so that the written information applied to these data areas are transferred to the top sheet 26' of the record sheet means 26 and then is simultaneously transferred by carbon sheet 26" to bottom duplicate register sheet 26"'.

It is to be understood that the coating medium 72 and/or carbon sheet 26" may be carbon treated paper or the so-called NCR paper. Also, even if the entire check included duplicating medium on the rear surface, the other data, including signature and written amount, on the check 48 would not be transferred to record sheet 26 since shield 45 is interposed beneath the remainder of check 48, i.e., all except that which is exposed through shield opening 62, and between check 48 and sheet means 26.

As seen in FIG. 8, the apparatus 10 is mounted onto the bottom portion 79 of a top opening check book cover 80 with flap 81 being inserted into a pocket slit in the lining 82, in a manner well known in the art. On the inside of the top cover 83 a glued edge pad of checks 85 is mounted in any suitable manner, and other locations of pockets or the like are provided for Deposit Slips 86 and an account list 87 of accounts by number and written description. With this information the user may automatically record a duplicate copy of each check written, as to the pertinent accounting data of DATE, TO THE ORDER OF (Payee) and AMOUNT, and the other pertinent data is directly applied to the record sheet means 26 which is supported by the right portion 14 of board 11. The other data includes the Expense Code from the Chart of Accounts 87, check number, balance of bank account and any explanation for an item of expense. Provision is also made for recording the deposits of income or the like directly to sheet 26, as well as any cash expenses desired. Thus, sheet 26 is intended to and is capable of reflecting all money in and all money out, as a complete financial journal for an individual or any small business. Thereafter, it is intended that either sheet 26' or 26" be sent to the bank or other computer service and a financial statement can be prepared which is also intended to reflect the current monthly and yearly budgets, as well as the current monthly and yearly expenses and income.

The apparatus is preferably made of lightweight materials such as plastic or aluminum and many of the details of construction are common and well known techniques, such as the reinforcing bottom ribs 90 in board 11, as well as the attachments 91 between flap 81 and board 11. The plate 12 herein is shown to be supported by a plurality of spaced feet 95 which rest on recessed portion 13 and slide easily thereover. Furthermore these feet 95 cause edge portion 19 to be in a normally raised position to cause the indexing means to be engaged, and when a slight pressure downwardly is exerted on support 35 or adjacent the edge portion 19 of plate 12, the indexing means releases plate for ready movement thereof.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. A sheet entry and automatic copying apparatus for use in making entries on a means which includes a plurality of record sheets with pressure sensitive duplication means therebetween comprising a writing board of a predetermined area, a movable carriage plate being of an area smaller than said predetermined area and positioned above said board, guide means connected to said board for movably mounting said plate to said board, said guide means comprising indexing means for restraining said plate in one and another predetermined selected position with respect to said board, record sheet-positioning means disposed on said board for releasably connecting such record sheet means thereto with such sheet means at least partially overlying said plate and said board, a shield overlying said plate and carried thereby for movement therewith, said shield and plate being adapted to sandwich such record sheet means therebetween, said shield having an opening therethrough for transferring information from pertinent data areas of an entry sheet to such record sheet means, said plate comprising positioning means for positively positioning such entry sheet and said shield thereon, said shield generally coextensive with and underlying such entry sheet with said shield opening registering with pertinent data areas of such entry sheet, said shield having a solid portion underlying and extending across areas adjacent said pertinent areas of such entry sheet to shield said record sheet means in the areas underlying said areas adjacent said pertinent areas, and a rigid anvil having a shape complementary to said shield opening and of a size smaller than said opening, said anvil being carried by said plate in underlying relation to said shield opening, said anvil being of a thickness generally the thickness of said shield whereby such record sheet means positioned overlying said anvil will be pushed by said anvil into said shield opening generally in the plane of the upper surface of said shield.

2. In the apparatus as defined in claim 1 wherein said shield opening is defined by a single horizontal slot, said horizontal slot being adapted to substantially underlay a duplicating media disposed on the rear surface of such entry sheet with the pertinent data areas being disposed thereabove.

3. In the apparatus as defined in claim 1 wherein said shield is removably attached to said plate.

4. In the apparatus as defined in claim 1 wherein said entry sheet-positioning means includes a pair of spaced pins extending upwardly from said plate.

5. In the apparatus as defined in claim 1 wherein said record sheet-positioning means includes a pair of spaced pins extending upwardly from said board.

6. In the apparatus as defined in claim 1 further comprising securing means attached to said plate for fixing such entry sheet in the position on said entry sheet-positioning means.

7. In the apparatus as defined in claim 6 wherein said securing means includes means for selectively engaging and releasing such entry sheet.

8. In the apparatus as defined in claim 7 wherein said securing means further includes spring means for biasing said means for selectively engaging and releasing in an engaging direction.

9. In the apparatus as defined in claim 1 wherein said board is generally rectangular and said guide means is disposed along the left side edge portion of said board.

10. In the apparatus as defined in claim 9 wherein said record sheet-positioning means is disposed adjacent the top edge portion of said board.

11. In the apparatus as defined in claim 1 wherein each of said board and said plate is generally rectangular.

12. In the apparatus as defined in claim 11 wherein said guide means includes stop means for limiting the movement of said plate to within the area defined by said board.

13. In the apparatus as defined in claim 11 wherein said board includes an upper surface for supporting a portion of such record sheet means, said plate having an upper surface generally coplanar with said board upper surface.

14. In the apparatus as defined in claim 11 wherein said board includes an upper surface for supporting a portion of such record sheet, said shield having an upper surface, when disposed on said plate, substantially coplanar with said board upper surface.

15. In the apparatus as defined in claim 1 wherein said guide means includes an elongated element disposed spacedly above said board, said plate having an edge portion slidingly disposed between said element and said board, said indexing means being attached to said edge portion and including a pair of spaced projections, said element including a plurality of spaced indentations cooperatively disposed with said projections whereby said plate may be selectively moved along and indexed on said element.

16. In the apparatus as defined in claim 15 wherein said guide means includes stop means between said board and each each of said elongated element thereby limiting the movement of said plate to within the area defined by said board.

17. In the apparatus as defined in claim 15 wherein said plate and said element are sufficiently resiliently deformable to permit ready movement of said plate in their deformed conditions while maintaining accurate positioning in appropriate indexed positions in their normal condition.

18. In the apparatus as defined in claim 1 wherein said board includes a recessed portion for accommodating said plate in its various indexed positions and a record sheet-supporting portion, said supporting portion and said plate having upper surfaces generally coplanar for supporting such record sheet means thereon.

* * * * *